United States Patent [19]

Berner, Jr. et al.

[11] Patent Number: 5,044,828

[45] Date of Patent: Sep. 3, 1991

[54] SUPPORT TOWER FOR OFFSHORE WELL

[75] Inventors: Paul C. Berner, Jr., Southside Place; William C. Kazokas, Jr., Mesquite, both of Tex.

[73] Assignee: Atlantic Richfield Company, Los Angeles, Calif.

[21] Appl. No.: 478,113

[22] Filed: Feb. 9, 1990

[51] Int. Cl.[5] ..... E02D 5/54

[52] U.S. Cl. ..... 405/202; 166/350; 405/195

[58] Field of Search ..... 405/195, 202, 203, 204, 405/224; 52/DIG. 10; 166/355, 359, 350, 367, 364, 368

[56] References Cited

U.S. PATENT DOCUMENTS

| | | | |
|---|---|---|---|
| 3,220,152 | 11/1965 | Sturm | 52/DIG. 10 |
| 3,221,464 | 12/1965 | Miller | 52/DIG. 10 |
| 3,277,614 | 10/1966 | Marie | 52/DIG. 10 |
| 3,636,716 | 1/1972 | Castellanos | 405/202 |
| 4,127,003 | 11/1978 | Vilain | 405/202 |
| 4,505,620 | 3/1985 | Andrier | 405/202 X |
| 4,768,984 | 9/1988 | de Oliveira et al. | 405/195 X |

FOREIGN PATENT DOCUMENTS

| | | | |
|---|---|---|---|
| 1175912 | 11/1958 | France | 52/DIG. 10 |

*Primary Examiner*—Dennis L. Taylor

*Attorney, Agent, or Firm*—Michael E. Martin

[57] ABSTRACT

Built-up towers for offshore wells, production platforms and for microwave communications antennae, for example, are formed of triangular base members which may be made up of equilateral triangles which are arranged vertically spaced from each other and with their base legs laterally and vertically spaced, respectively, and so that the centroids of the triangles formed by said base members are aligned along a common longitudinal axis of the tower. Each of the triangular base members is connected to an adjacent base member by lateral braces which extend between the apices or nodes of each triangle to the adjacent apices or nodes of the adjacent base member.

9 Claims, 4 Drawing Sheets

32
30
26
28
24
22
20
34
36
10
16
18
14
12

30
33
31
26
28
24
17
10
22
20
19
33
16
18
14
33
12

SUPPORT TOWER FOR OFFSHORE WELL

BACKGROUND OF THE INVENTION

1. Field of the Invention

The present invention pertains to a support tower particularly adapted for use as part of an offshore well structure but which is useful in other applications wherein tower rigidity, reduced mass and reduced loads caused by aerodynamic and hydrodynamic forces are important.

2. Background

Certain applications of structural towers require a combination of rigidity, low mass and reduced loads imposed thereon by aerodynamic or hydrodynamic forces. One such application is in a unique offshore well structure of a type described previously in U.S. patent application Ser. No. 07/423,498; filed Oct. 12, 1989 to William C. Kazokas, Jr. and now U.S. Pat. No. 4,934,871 assigned to the assignee of the present invention. Certain other applications in conjunction with offshore wells or production facilities also require towers which are relatively rigid, and present low resistance to ocean waves or currents. The overall size of certain types of offshore towers or so-called jackets also emphasize the need to reduce the mass and structural complexity of these towers to minimize their cost.

Accordingly, there has been a long-felt need in many tower applications, but particularly with respect to offshore well and production facilities, to provide a tower which is substantially rigid, has relatively low mass and structural complexity, and presents minimal resistance to wave and current action of the body of water in which the tower is disposed. To this end the present invention has been developed with a view to providing a tower which meets the desiderata described herein.

SUMMARY OF THE INVENTION

The present invention provides a unique, built-up or truss type tower which is particularly useful in conjunction with offshore well structures and as support structures for production platforms and the like and other applications requiring high degrees of rigidity.

In accordance with an important aspect of the present invention there is provided a built-up type tower which is made up of a plurality of members interconnected to form triangular base members together with interconnecting or lateral members which are also arranged in a triangular configuration in such a way that a tower is provided which has substantial rigidity, requires significantly fewer structural members than conventional towers and has significantly lower drag or reaction to aerodynamic and hydrodynamic forces.

The tower of the present invention is characterized by vertically spaced apart triangular base members wherein alternate ones of the base members are arranged to have their respective base legs parallel and spaced laterally as well as vertically from each other. In one preferred embodiment the base members are configured as equilateral triangles which are arranged such that each leg of the triangle forming a base member is parallel and laterally spaced from a corresponding leg of the triangle forming the adjacent base member and the base members are also arranged such that their centroids lie along a common central axis of the tower.

In accordance with yet another aspect of the present invention the base members are interconnected at their nodes or apices by lateral brace members which extend from each node of a base member to the nearest adjacent nodes of the adjacent base member, respectively. Accordingly, in this way the tower is also made up of triangular elements extending in planes which may be almost normal to the triangular base members. These triangular elements comprise a leg of a base member and at least two lateral brace members extending between base members. Such an arrangement provides a structure formed of triangles in each face of the structure and is a particularly rigid and lightweight structure with a reduced number of structural members for a given strength and support capability.

In accordance with yet a further aspect of the present invention there are or may be provided towers having the features described hereinabove which are particularly adapted for use as support towers for offshore gas and oil producing platforms, drilling platforms and other offshore structures.

Yet another type of tower which is particularly useful, in accordance with the present invention, is a support tower for microwave transmission and receiving antennae and wherein the tower is particularly rigid and suited for use for applications wherein minimal movement of the tower is desired and, hence, low reaction to aerodynamic forces is important. Still further, towers or support beams in accordance with the present invention may be advantageously used in structures for outer space applications, thanks to the lightweight, high rigidity or stiffness and structural simplicity features.

Those skilled in the art will recognize the above-described features and important aspects of the present invention as well as other advantages thereof upon reading the detailed description which follows in conjunction with the drawing.

DESCRIPTION OF PREFERRED EMBODIMENTS

Figure 1:
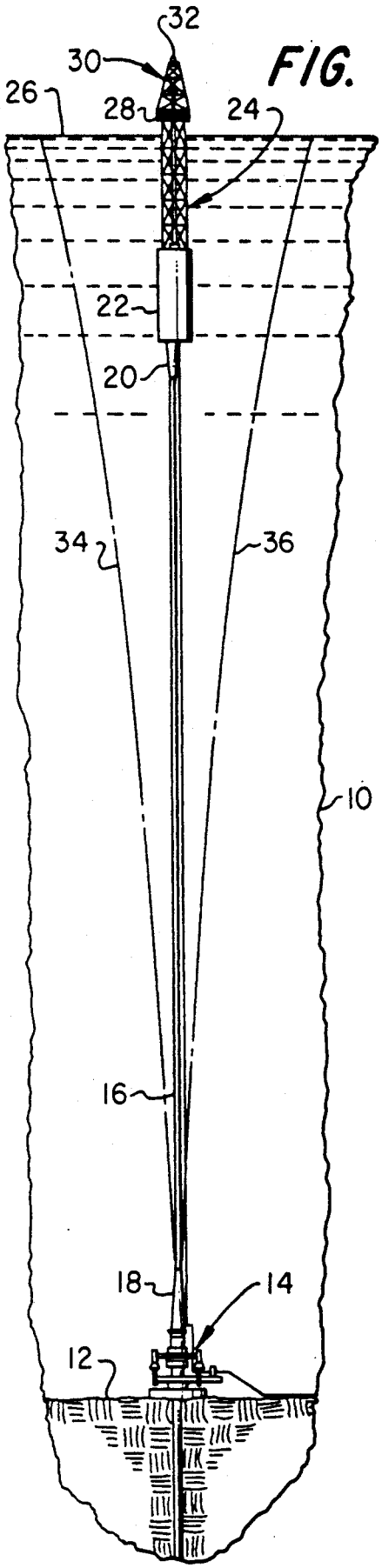
FIG. 1 is a side elevation of an offshore well support structure utilizing the tower of the present invention.

In the description which follows, like parts are marked throughout the specification and drawing with the same reference numerals, respectively. The drawing figures may not be to scale and some components may be shown in somewhat schematic or generalized form in the interest of clarity and conciseness.

Referring to FIG. 1, there is illustrated an offshore sub-sea well arrangement wherein, in a body of water 10, the sea floor 12 supports a wellhead 14 to which is connected a vertically extending tubular member or riser pipe 16. The riser 16 is connected to the wellhead 14 by a generally conically tapered, stress distributing section 18. The opposite end of the riser is connected to a second stress distributing section 20 and wherein the riser is also connected to a buoyancy member 22. The buoyancy member 22 supports a unique tower in accordance with the present invention and generally designated by the number 24. The tower 24 extends above the sea surface 26 and supports a platform 28 on which a set of well control valves or "Christmas Tree" 30 is disposed. The platform 28 also supports a navigation beacon 32. The riser 16 is adapted to be somewhat flexible to allow lateral excursion of the riser together with the buoyancy member 22 and the tower 24 within an envelope generally delimited by the centerlines 34, 36.

Figure 2:
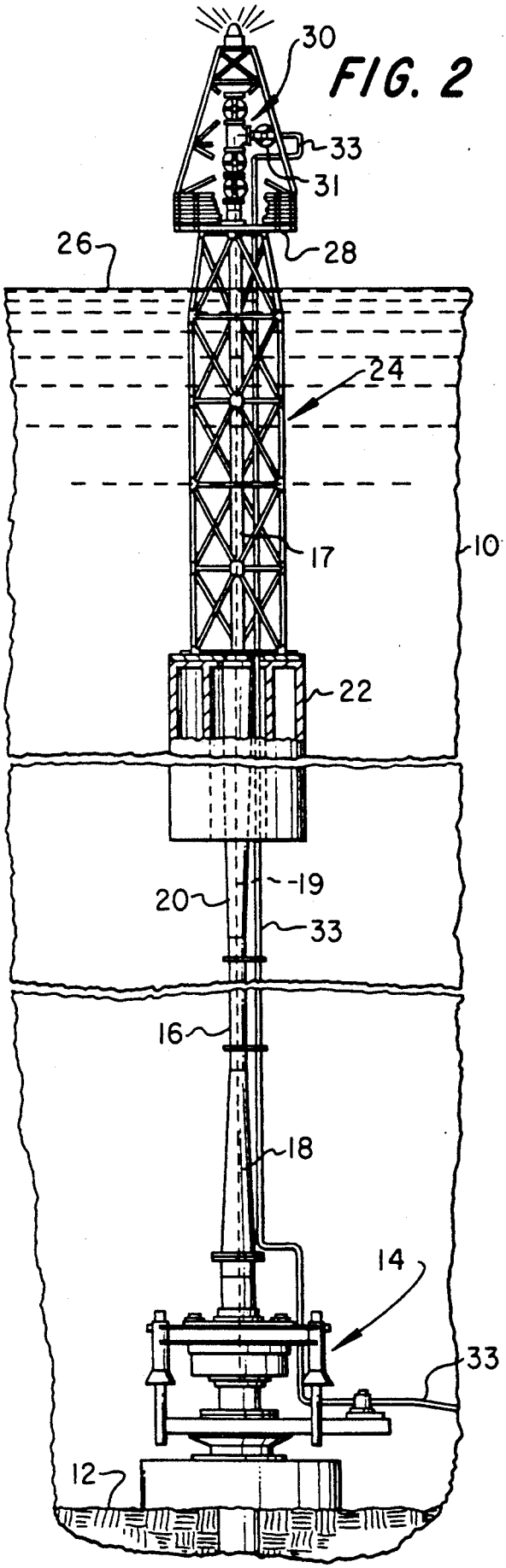
FIG. 2 is a view similar to FIG. 1 on a larger scale showing further details of the tower which supports an above-water wellhead.

FIG. 2 illustrates further details of the offshore well including the buoyancy member 22 and the tower 24. An extension 17 of the riser 16 is disposed within the interior of the tower 24 and extends to the Christmas Tree 30. The offshore well structure described and illustrated in FIGS. 1 and 2 has numerous advantages as described further in the above-mentioned U.S. patent application Ser. No. 07/423,498. As shown in FIG. 2, the tower 24 extends from the buoyancy member 22 to the platform 28 in supporting relationship thereto and to the riser extension 17 and the Christmas tree 30. At least one well production fluid flow conduit 19 extends from the subsea wellhead 14 through the riser 16, 17 to a valve 31 on the Christmas Tree 30. The tower 24 and riser 16, 17 also support a continuation of the conduit 19, indicated by the numeral 33, which extends down to the wellhead 14 adjacent the seafloor 12.

A major portion of the tower 24 is submerged in the body of water 10 below the surface 26 and is subject to considerable wave action and current action of such body of water. Moreover, although it is important that the riser 16 be flexible to allow lateral excursion of the offshore well structure it is desired that the tower 24 be substantially rigid, relatively lightweight so as to minimize the buoyancy requirements of the member 22, and present relatively low drag or resistance to the flow of water against and around the tower. Of course, the tower 24 must meet certain structural requirements with respect to supporting the platform 28 and the assemblage of valves comprising the Christmas Tree 30.

Figure 3:
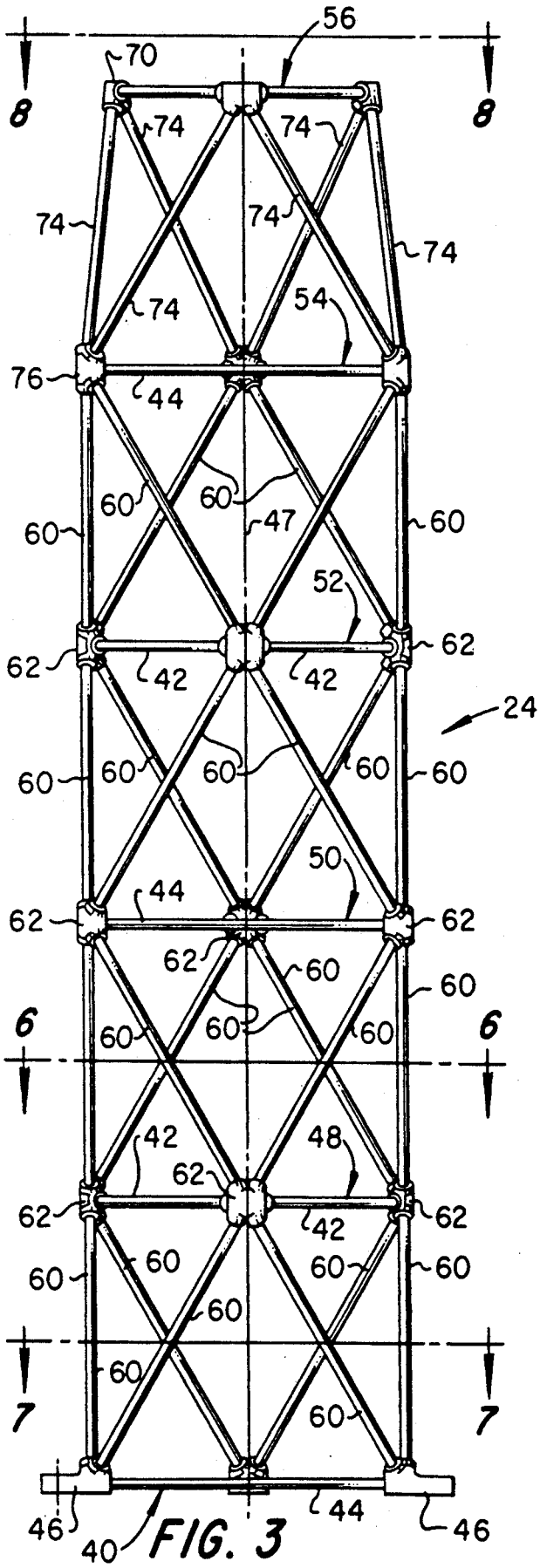
FIG. 3 is a side elevation of a tower in accordance with the present invention.
Figure 7:
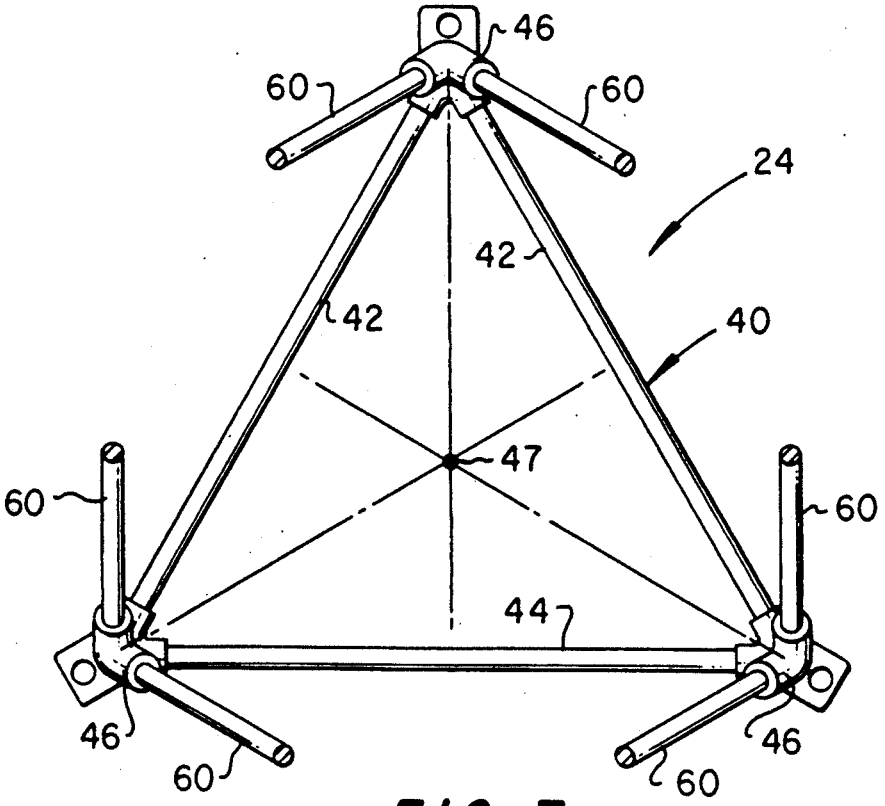
FIG. 7 is a view taken along the line 7—7 of FIG. 3.

In accordance with the present invention, and as illustrated also in FIG. 3 and the section views taken along the lines indicated in FIG. 3, the tower 24 is made up of a unique arrangement of spaced apart triangular base members and lateral or inclined brace members interconnecting the respective base members. Referring, for example, to FIGS. 3 and 7, the tower 24 is made up of a plurality of triangular base members, such as the lowermost base member 40, each of the base members having opposed legs 42 and a base leg 44. In the embodiment of the tower shown in FIGS. 3, 6, 7 and 8 each of the base members is made up of legs and base legs of equal length to form equilateral triangles. The legs of the lowermost base member 40 are interconnected by node members 46 which may be formed as cast or forged parts having suitable receptacles for receiving the distal ends of each of the legs 42 and the base leg 44. The legs 42 and the base leg 44 may be made up of metal cylindrical tubes or rods which are fitted in the receptacles of the node members 46 and suitably secured therein such as by welding. Alternatively, the leg members 42 and 44 may be fabricated of other structural shapes and interconnected by node members of other configurations suitable for interconnecting such other leg members.

The tower 24 is also formed of additional base members 48, 50, 52, 54 and 56. At least the base members 48, 50, 52 and 54 are of identical construction and each comprise opposed leg members 42 and a base leg 44 which, if of equal length, are common parts and form equilateral triangles. In accordance with an important aspect of the present invention, however, the base members of the tower are arranged such that the leg members 42 and 44 of each base member are spaced apart laterally as well as vertically with respect to the corresponding leg members and base leg and to a longitudinal central axis 47 of the tower 24. Still further, the triangular base members 40, 48, 50, 52, 54 and 56 are preferably arranged such that their centroids or orthocenters are coincident with the axis 47. The base member 48, made up of leg members 42 and 44, is interconnected with the base member 40 by lateral brace members 60. The members 60 extend between the node members 46 and additional node members 62 which interconnect the leg members 42 and 44 of the base member 48 and also interconnect the brace members 60 with the base member 48.

As illustrated in FIG. 3, the arrangement of the base members 50, 52 and 54 with respect to each other is similar to the arrangement of the base members 40 and 48 with respect to each other. That is, each of the triangular base members 50, 52 and 54 are arranged with respect to each other such that their centroids lie along the axis 47 and their base leg members 44 are spaced laterally as well as vertically from each other. In this way alternate ones of the base members 40, 48, 50, 52, and 54 are aligned vertically with each other. In the exemplary tower 24 the base members 48 and 50 are interconnected by the lateral brace members 60 which extend between node members 62. The brace members 60 may be of the same configuration and of the same length as the leg members 42 and 44. Certainly, for structural standardization and economy of manufacture, the members 42, 44 and 60 may be of the same dimensions and a substantial commonality of parts is also advantageously provided by the node members 62.

Figure 8:
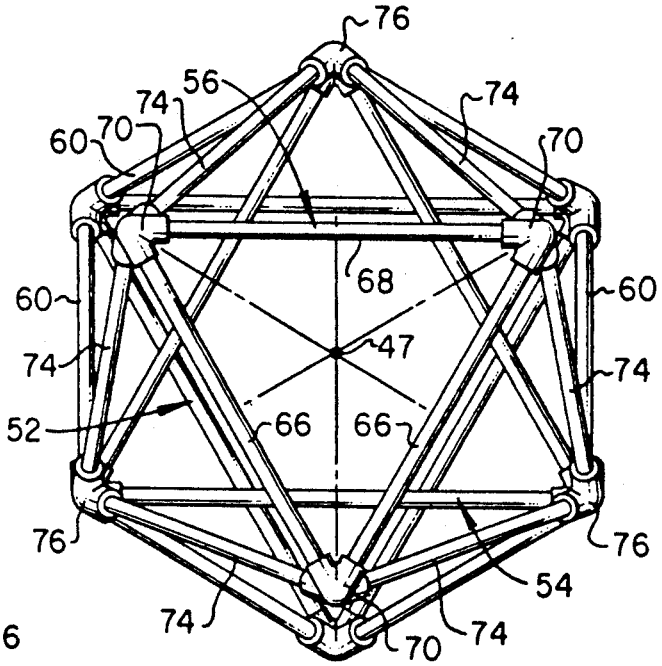
FIG. 8 is a view taken along the line 8—8 of FIG. 3.

Alternatively, one or more of the base members of a tower in accordance with the present invention may be made up of leg members which are shorter in length than the leg members 42 and 44. For example, with respect to the tower 24 the uppermost, generally horizontal, base member 56 is made up of legs 66 and a base leg 68, FIG. 8, which may be of equal length and interconnected by node members 70. The node members 70 also provide for connecting the base member 56 to lateral brace members 74 which extend between the base members 54 and 56. In the event that base member configurations having shorter leg lengths than the adjacent base member are provided in a tower in accordance with the present invention, then the node members such as the node members 70 and 76, FIGS. 3 and 8, will have geometries different from the node members 46 and 62 which interconnect base members of equal size. Although the base member 56 is smaller than the base members 52 and 54 its centroid is also aligned with or coincident with the axis 47, as illustrated in FIG. 8.

The configuration of the tower 24, as described herein and illustrated in conjunction with FIGS. 1 through 3 and 6 through 8, is particularly advantageous in that a substantially rigid tower having as many as fifty percent fewer members than certain other truss-type towers is provided. In fact, the tower 24 may have up to twenty-seven percent less mass and thirty percent less drag when exposed to aerodynamic or hydrodynamic forces as compared with certain other conventional truss structures, also.

Figure 4:
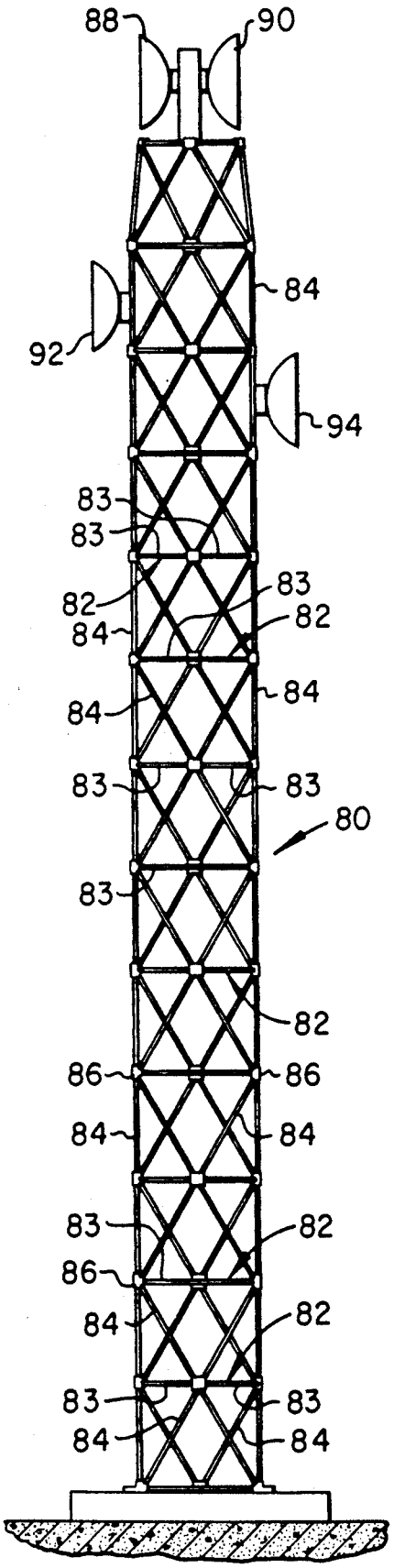
FIG. 4 is a side elevation of a microwave antenna support tower in accordance with the present invention.
Figure 6:
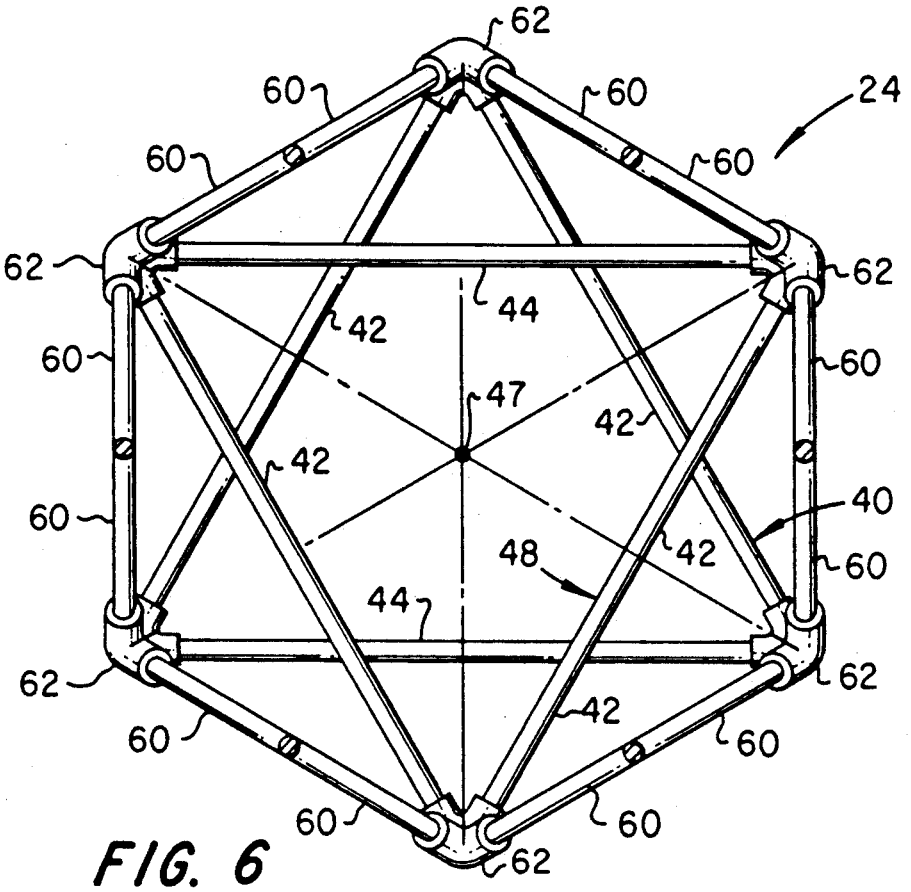
FIG. 6 is a view taken along the line 6—6 of FIG. 3.

The abovenoted advantages are particularly useful for towers for certain other applications such as illustrated in FIG. 4. In FIG. 4 there is illustrated a tower 80 generally of the configuration of the tower 24 and having a plurality of base members 82 made up of triangular leg members 83 similar to the base members 40, 48 and 50 and which are interconnected by lateral brace members 84 at respective node members 86. The tower 80 is particularly advantageous for application as a receiving and transmission or relay tower for microwave range electromagnetic radiation communications. The tower 80 is provided with receiving and transmitting antennae 88, 90, 92 and 94, for example. The stiffness of the tower 80 is particularly important for electromagnetic radiation receiving and transmitting antenna structures to avoid any unwanted excursion of the antennae with respect to a signal source or a signal receiving point to preclude signal transmission degradation. Moreover, other applications, such as structures placeable in planetary orbit and interplanetary transit, may also utilize the tower configuration of the present invention.

Figure 5:
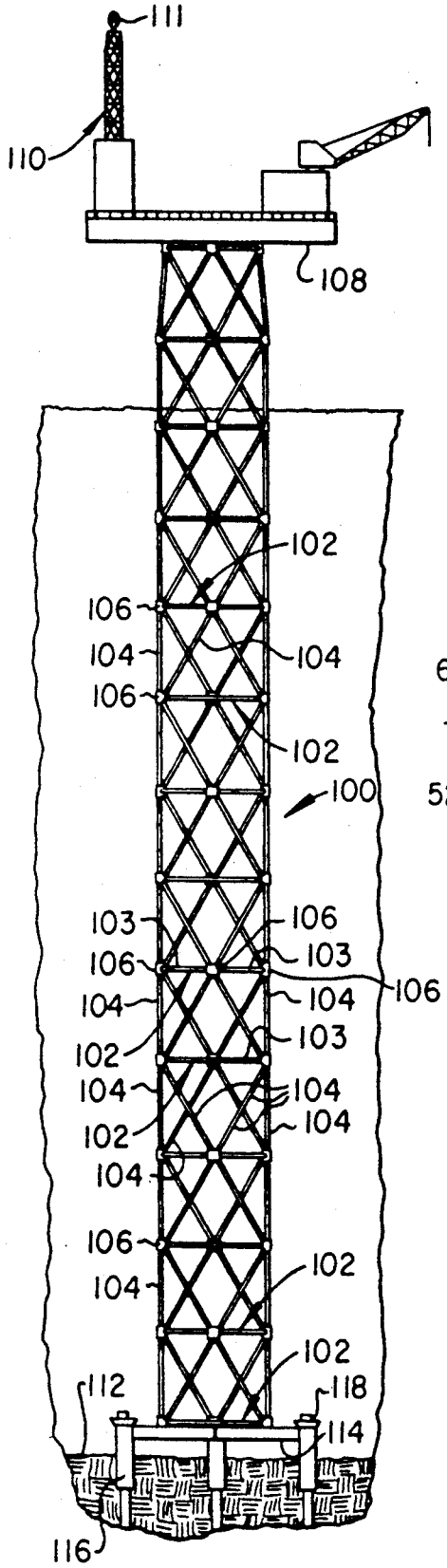
FIG. 5 is a side elevation of an offshore support tower for a drilling or production platform in accordance with the present invention.

Still further, the tower configuration of the present invention is useful for adaptation as a platform support tower or jacket for offshore drilling and production of hydrocarbons. As illustrated in FIG. 5, there is provided a tower 100, having generally the configuration of the tower 24, with spaced apart and similarly configured base members 102, made up of equal length leg members 103, and which are interconnected by lateral brace members 104 at node members 106. The tower 100 supports a platform 108 which may be used for oil and gas production operations or well drilling and which may, in fact, support an additional tower 110 similar to the tower 100 for supporting a gas flare 111, for example. The tower 110 is of the same general configuration as the towers 24, 80 and 100. The tower 100 is supported at a sea floor 112 by a pile anchored template or base 114 having a plurality of pile sleeves 116 through which have been driven support and anchoring piles 118 in accordance with conventional practice in offshore oil and gas well drilling and production structures.

Referring briefly again to FIGS. 6 and 7, those skilled in the art will recognize that the configuration of the base members 40, 48 and so on do not require that the triangular configuration provided by the legs 42 and 44 form an equilateral triangle. The base leg 44 may, for example, be longer or shorter than the legs 42 but the symmetry of the tower and the stiffness are enhanced by placing the centroids or orthocenters of each triangular base member in alignment with each other along a common axis. Moreover, the structural loading on the lateral brace members may be more evenly distributed if symmetry is provided with respect to adjacent spaced apart base members.

Although preferred embodiments of a built-up or so called truss type tower have been described in detail herein, and although those skilled in the art will recognize that the towers described may be built using conventional engineering materials and techniques for structural towers, the advantages and superior features of the invention may be enjoyed by other towers which come within the scope and spirit of the invention as recited in the appended claims.

What is claimed is:

1. A freestanding tower for an offshore well wherein said tower extends from a point below the sea surface to a point above the sea surface, said tower comprising:

a plurality of generally vertically spaced apart triangular base members, adjacent ones of said base members being oriented such that the apices of said base members are not aligned with each other, each of said base members being made up of a triangular having two opposed legs and a base leg wherein at least said two opposed legs are of equal length and the centroids of said base members are aligned with each other along a common axis of said tower; and a plurality of lateral brace members interconnecting said base members by extending between adjacent apices of said adjacent ones of said base members, respectively, said legs and said brace members comprising at least one of generally cylindrical, rigid tubes or rods wherein said tower presents minimum hydrodynamic resistance to wave and current action of the sea.

2. The tower set forth in claim 1 wherein:

said base members are made up of equilateral triangles.

3. The tower set forth in claim 1 wherein:

said base members comprise triangles having base legs and said base legs of adjacent ones of said base members are spaced laterally from each other.

4. The tower set forth in claim 3 wherein:

said base legs of said adjacent ones of said base members are parallel to each other, respectively.

5. The tower set forth in claim 1 wherein:

at least one of said base members comprises a triangle having opposed legs which are of different length with respect to the corresponding legs of certain others of said base members.

6. The tower set forth in claim 1 wherein:

the apices of said base members are formed by node members for interconnecting the legs of said base members with each other and with said brace members, respectively.

7. The tower set forth in claim 1 wherein:

said lateral brace members and a leg of a base member form a triangle in a plane extending at an angle with respect to a plane containing said base member.

8. The tower set forth in claim 1 wherein:

said well includes wellhead means disposed adjacent the seabed;

an elongated riser extending upwardly from the seabed toward the sea surface;

means interconnecting said riser at its lower end with said wellhead means;

buoyancy means connected to said riser for exerting a buoyant upward force;

an upper portion of said riser extending through said tower and above the sea surface; and flow control means connected to the upper end of said upper portion of said riser and extending a relatively short distance above the sea surface for controlling the flow of fluids with respect to said well.

9. The tower set forth in claim 8 wherein:

said riser includes conduit means extending there through between said flow control means and said means interconnecting said riser with said wellhead means for conducting fluids between said wellhead means and said flow control means.

* * * * *